US008333306B2

(12) United States Patent
Han et al.

(10) Patent No.: US 8,333,306 B2
(45) Date of Patent: Dec. 18, 2012

(54) ICE DISPENSING TECHNOLOGY IN WHICH A DUCT-COVERING PART IS CONTROLLED TO ACCOUNT FOR ABNORMAL OPERATION

(75) Inventors: Seung Do Han, Seoul (KR); Ho Youn Lee, Seoul (KR); Young Jin Kim, Seoul (KR); Tae Hee Lee, Seoul (KR); Sung Yong Shin, Seoul (KR)

(73) Assignee: LG Electronics Inc., Seoul (KR)

( * ) Notice: Subject to any disclaimer, the term of this patent is extended or adjusted under 35 U.S.C. 154(b) by 756 days.

(21) Appl. No.: 12/488,636

(22) Filed: Jun. 22, 2009

(65) Prior Publication Data

US 2010/0122751 A1 May 20, 2010

(30) Foreign Application Priority Data

Nov. 14, 2008 (KR) ..... 10-2008-0113687

(51) Int. Cl.
*B67D 3/00* (2006.01)
*H02P 7/00* (2006.01)

(52) U.S. Cl. ..... 222/504; 222/63; 222/146.6; 62/340; 318/476

(58) Field of Classification Search ..... 222/23, 222/39, 52, 63, 146.6, 504; 62/340; 318/466, 318/474, 476
See application file for complete search history.

(56) References Cited

U.S. PATENT DOCUMENTS 4,347,465 A * 8/1982 Goertler et al. ..... 318/266
4,383,206 A * 5/1983 Matsuoka et al. ..... 318/445
4,394,605 A * 7/1983 Terazawa ..... 315/280
4,701,684 A * 10/1987 Seidel et al. ..... 318/282
4,739,233 A * 4/1988 Marcade ..... 318/474
5,474,213 A * 12/1995 Unger ..... 222/108
5,794,451 A 8/1998 Lee et al.
6,135,173 A * 10/2000 Lee et al. ..... 141/361
8,067,915 B2 * 11/2011 Hooker et al. ..... 318/466
2006/0202071 A1 9/2006 Jung et al.
2007/0119194 A1 5/2007 Kim et al.
2007/0119204 A1 * 5/2007 Kwon ..... 62/340
2007/0251259 A1 11/2007 Kim et al.
2007/0256442 A1 * 11/2007 Lyvers et al. ..... 62/344
2007/0295750 A1 12/2007 Cocchi et al.
2008/0061088 A1 3/2008 Part et al.
2008/0121667 A1 5/2008 Part et al.

(Continued)

FOREIGN PATENT DOCUMENTS

CN 1172936 A 2/1998

(Continued)

OTHER PUBLICATIONS

European Search Report dated May 4, 2011 for Application No. EP09008458, 6 pages.

(Continued)

*Primary Examiner* — Kevin P Shaver
*Assistant Examiner* — Patrick M Buechner
(74) *Attorney, Agent, or Firm* — Fish & Richardson P.C.

(57) ABSTRACT

An ice-making device includes a duct through which ice is dispensed and a duct-covering part opening and closing the duct. When an operation load applied to the duct-covering part while the duct-covering part closes the duct is greater than a preset normal load, the duct-covering part operates to open the duct.

18 Claims, 6 Drawing Sheets

U.S. PATENT DOCUMENTS

| | | | | |
|---|---|---|---|---|
| 2008/0134710 | A1 | 6/2008 | An et al. | |
| 2008/0156017 | A1 | 7/2008 | Johnson et al. | |
| 2010/0089492 | A1* | 4/2010 | Dirnberger et al. | 141/351 |
| 2010/0089493 | A1 | 4/2010 | Seo | |
| 2010/0122547 | A1* | 5/2010 | Han et al. | 62/340 |
| 2010/0200621 | A1* | 8/2010 | Buchstab et al. | 222/638 |

FOREIGN PATENT DOCUMENTS

| | | | |
|---|---|---|---|
| CN | 1755308 | A | 4/2006 |
| CN | 1967103 | A | 5/2007 |
| CN | 101738039 | B | 1/2012 |
| EP | 1701118 | A2 | 9/2006 |
| EP | 1930672 | A2 | 6/2008 |
| JP | 2007-509622 | A | 4/2007 |
| WO | WO 2005/0048730 | A1 | 6/2005 |
| WO | WO 2008/084973 | A1 | 7/2008 |

OTHER PUBLICATIONS

Patent Certification for Invention dated Jan. 4, 2012, with English Translation, 3 pages.

* cited by examiner

ICE DISPENSING TECHNOLOGY IN WHICH A DUCT-COVERING PART IS CONTROLLED TO ACCOUNT FOR ABNORMAL OPERATION

CROSS-REFERENCE TO RELATED APPLICATIONS

The present application claims priority under 35 U.S.C. 119 and 35 U.S.C. 365 to Korean Patent Application No. 10-2008-0113687 (filed on Nov. 14, 2008), which is hereby incorporated by reference in its entirety.

FIELD

The present disclosure relates to ice dispensing technology.

BACKGROUND

A refrigerator is a home appliance that can store foods in a freezing state or a refrigeration state. A refrigerator may include a dispenser that can dispense ice and/or water to an outside of the refrigerator. The refrigerator provided with the dispenser includes devices for making and dispensing the ice.

SUMMARY

In one aspect, an ice-making device includes a duct through which ice is dispensed and a duct-covering part configured to open and close the duct. The ice-making device also includes a control part that is configured to determine whether an operation load applied to the duct-covering part when the duct-covering part is attempting to close the duct is greater than a preset normal load and that is configured to control the duct-covering part to open the duct in response to a determination that the operation load applied to the duct-covering part when the duct-covering part is attempting to close the duct is greater than the preset normal load.

Implementations may include one or more of the following features. For example, the control part may be configured to determine whether the operation load applied to the duct-covering part when the duct-covering part is attempting to close the duct is greater than the preset normal load by determining whether an operation time during which the duct-covering part has been attempting to close the duct is greater than a preset normal time taken for closing the duct. The control part may be configured to determine whether the operation load applied to the duct-covering part when the duct-covering part is attempting to close the duct is greater than the preset normal load by determining whether an operation current applied to the duct-covering part when the duct-covering part is attempting to close the duct is greater than a preset reference current.

In response to a determination that the operation load applied to the duct-covering part when the duct-covering part is attempting to close the duct is greater than the preset normal load, the control part may be configured to control the duct-covering part to open and close the duct at least one time until the operation load reaches the preset normal load. The ice-making device may include a warning part configured to output a warning to a user. The control part may be configured to determine whether the operation of opening and closing the duct has been repeated because the operation load is greater than the normal load a preset number of times and control the warning part to output the warning to the user in response to a determination that the operation of opening and closing the duct has been repeated the preset number of times.

In another aspect, an ice-making device includes a duct through which ice is dispensed, a duct-covering part configured to open and close the duct, and a sensor part configured to sense an operation current applied to the duct-covering part when the duct-covering part is attempting to close the duct. The ice-making device also includes a control part that is configured to determine whether the sensed operation current applied to the duct-covering part when the duct-covering part is attempting to close the duct is greater than a preset reference current and that is configured to control the duct-covering part to open the duct in response to a determination that the sensed operation current applied to the duct-covering part when the duct-covering part is attempting to close the duct is greater than the preset reference current.

Implementations may include one or more of the following features. For example, the reference current may be equal to or greater than a starting current and a preset normal operation current. The starting current may be current applied to the duct-covering part when the duct-covering part initially begins closing the duct and the preset normal operation current may be current applied to the duct-covering part as the duct-covering part closes the duct without failure.

In response to a determination that the sensed operation current applied to the duct-covering part when the duct-covering part is attempting to close the duct is greater than the reference current, the control part may be configured to control the duct-covering part to open and close the duct at least one time until the operation current reaches the preset reference current or less. The ice-making device may include a warning part configured to output a warning to a user. The control part may be configured to determine whether the operation of opening and closing the duct has been repeated because the operation current is greater than the preset reference current a preset number of times and control the warning part to output the warning to the user in response to a determination that the operation of opening and closing the duct has been repeated the preset number of times.

In yet another aspect, a method of controlling an ice-making device includes controlling, using a control part, a duct-covering part to open a duct to allow dispensing of ice. Subsequent to dispensing ice through the duct, the method includes controlling, using the control part, the duct-covering part to close the duct. In response to controlling the duct-covering part to close the duct, the method includes determining whether an operation load applied to the duct-covering part when the duct-covering part is attempting to close the duct is greater than a preset normal load and controlling, using the control part, the duct-covering part to reopen the duct in response to a determination that the operation load applied to the duct-covering part when the duct-covering part is attempting to close the duct is greater than the preset normal load.

Implementations may include one or more of the following features. For example, the method may include controlling, using the control part, the duct-covering part to attempt to close the duct again after controlling the duct-covering part to reopen the duct. The method also may include controlling, using the control part, the duct-covering part to repeatedly open the duct and attempt to close the duct until the operation load reaches the preset normal load while the duct-covering part attempts to close the duct. The method further may include determining, using the control part, whether, in attempting to close the duct, an operation to open and close the duct has been repeated a preset number of times and outputting, using a warning part, a warning to a user in response to a determination that an operation to open and close the duct has been repeated the preset number of times.

In some implementations, the method may include determining whether an operation current applied to the duct-covering part when the duct-covering part is attempting to close the duct is greater than a preset reference current. In these implementations, the method may include determining whether an operation current sensed by a sensor part and applied to the duct-covering part when the duct-covering part is attempting to close the duct is greater than a starting current and a preset normal operation current, the starting current being current applied to the duct-covering part when the duct-covering part initially begins closing the duct, and the preset normal operation current being current applied to the duct-covering part as the duct-covering part closes the duct without failure.

In some examples, the method may include controlling, using the control part, the duct-covering part to attempt to close the duct again after controlling the duct-covering part to reopen the duct. In these examples, in response to a determination that the sensed operation current applied to the duct-covering part when the duct-covering part is attempting to close the duct is greater than the reference current, repeating opening and closing of the duct at least one time until the operation current reaches the reference current. The method may include determining, using the control part, whether, in attempting to close the duct, an operation to open and close the duct has been repeated a preset number of times and outputting, using a warning part, a warning to a user in response to a determination that an operation to open and close the duct has been repeated the preset number of times.

In some implementations, the method may include determining whether an operation time during which the duct-covering part has been attempting to close the duct is greater than a preset normal time taken for closing the duct. In these implementations, the method may include controlling, using the control part, the duct-covering part to repeatedly open the duct and attempt to close the duct until the duct-covering part closes the duct in an operation time that is less than or equal to the preset normal time taken for closing the duct.

The details of one or more implementations are set forth in the accompanying drawings and the description below. Other features will be apparent from the description and drawings, and from the claims.

DETAILED DESCRIPTION

Figure 1:
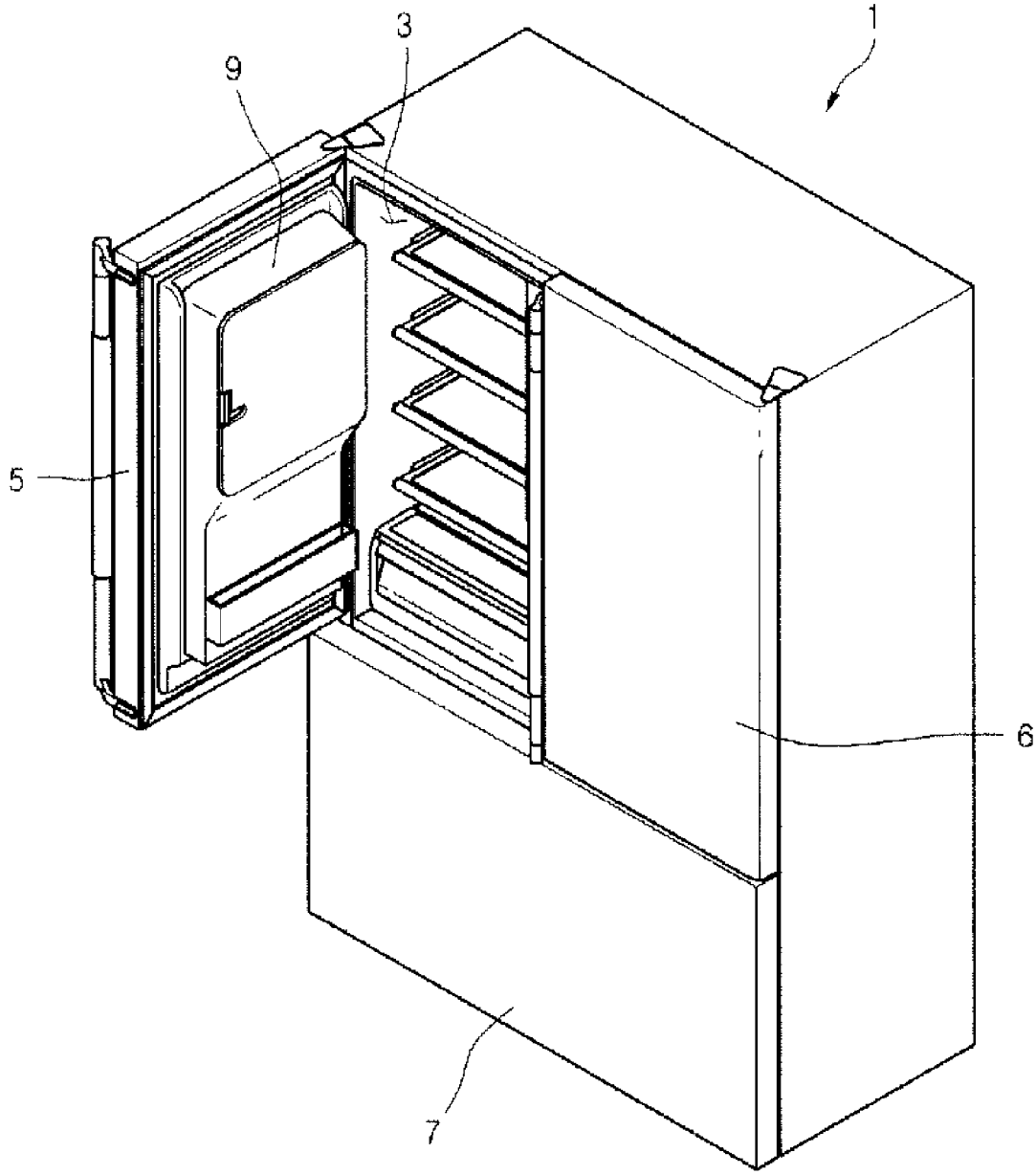
FIG. 1 is a perspective view illustrating a refrigerator with an ice-making device.
Figure 2:
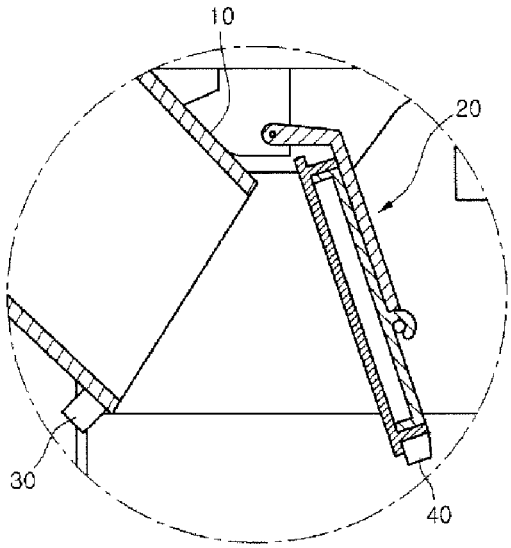
FIG. 2 is a cross-sectional view illustrating a part of an ice-making device.
Figure 3:
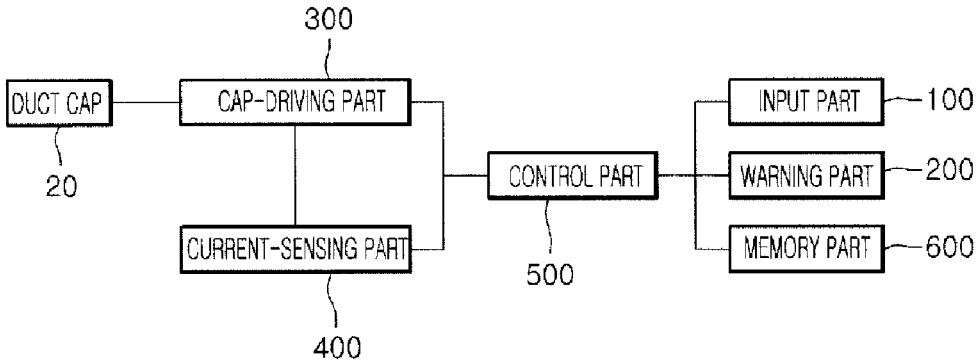
FIG. 3 is a block diagram illustrating configuration of an ice dispensing control system.

FIG. 1 illustrates an example of a refrigerator with an ice-making device. FIG. 2 illustrates a cross-section of an example of a part of an ice-making device. FIG. 3 illustrates an example configuration of an ice dispensing control system.

Referring to FIG. 1, a refrigerator compartment 3 and a freezer compartment are disposed in a main body 1. The refrigerator compartment 3 and the freezer compartment, where foods are stored, are arranged vertically in the main body 1, with the refrigerator compartment 3 being positioned above the freezer compartment. The refrigerator compartment 3 is opened and closed by refrigerator compartment doors 5 and 6 and the freezer compartment is opened and closed by a freezer compartment door 7.

An ice-making chamber 9 is provided to an inner surface of the refrigerator compartment door 5 (hereinafter, referred to as a "door"). The ice-making chamber 9 is separated from the refrigerator compartment 3, and an ice-making device (not shown) for making ice is disposed in the ice-making chamber 9.

A front surface of the door 5 is provided with a dispenser (not shown). The dispenser is used to dispense water and/or ice without opening the door 5.

Referring to FIG. 2, an ice duct 10 is disposed in the door 5. The ice duct 10 is used to dispense ice made by the ice-making device to an outside of the refrigerator, that is, to the outside of the refrigerator through the dispenser which transports ice through the door 5 when the door 5 is in a closed positioned. To this end, a first end of the ice duct 10 communicates with the ice-making device and a second end of the ice duct 10 communicates with the dispenser.

A duct cap 20 opens and closes an end of the ice duct 10 adjacent to the dispenser (e.g., the second end of the ice duct 10 that communicates with the dispenser). One end of the duct cap 20 rotates about the other end to open and close the ice duct 10.

The ice duct 10 and the duct cap 20 are provided with a hall sensor 30 and a magnet 40, respectively. In the state where the duct cap 20 closes the ice duct 10, the hall sensor 30 and the magnet 40 may be disposed at a position where the ice duct 10 faces the duct cap 20. The hall sensor 30 and the magnet 40 sense a position of the duct cap 20 relative to the ice duct 10. More particularly, the hall sensor 30 provided to the ice duct 10 senses strength (e.g., presence or absence) of a magnetic field of the magnet 40 provided to the duct cap 20 and, thereby, senses the position of the duct cap 20 relative to the ice duct 10. When the duct cap 20 closes the ice duct 10, the hall sensor 30 senses a relatively strong (e.g., a present) magnetic field and detects that the duct cap 20 is in a position to close the ice duct 10. When the duct cap 20 opens the ice duct 10, the hall sensor 30 senses a relatively weak (e.g., an absent) magnetic field and detects that the duct cap 20 is in a position to open the ice duct 10.

Referring to FIG. 3, an input part 100 receives an operation signal for dispensing ice through the dispenser. A warning part 200 displays whether the duct cap 20 is in abnormal operation. The warning part 200 may display the abnormal operation of the duct cap 20 using a lamp on/off, display of characters or symbols, any type of visual display, or an audible output (e.g., a voice output).

A cap-driving part 300 provides a driving force for rotating the duct cap 20. For example, the cap-driving part 300 may include a solenoid valve or a motor. That is, the cap-driving part 300 rotates in a predetermined direction or a reverse direction, so that the duct cap 20 opens or closes one end of the ice duct 10. Current is applied to the cap-driving part 300 to rotate the duct cap 20. A starting current is applied during an initial driving of the cap-driving part 300, and a normal operation current or a load operation current is applied while the cap-driving part 300 is driven. The normal operation current is a current applied to the cap-driving part 300 when a normal load, that is, a load corresponding to the weight of the duct cap 20 is applied to the cap-driving part 300. The load operation current is a current applied to the cap-driving part 300 during an abnormal load, that is when a load added to the weight of the duct cap 20 is applied to the cap-driving part 300, for example, when a foreign substance such as ice is caught between the ice duct 10 and the duct cap 20 during the operation of the duct cap 20, so as to interfere with the normal operation of the duct cap 20. Thus, the normal operation current is lower than the starting current and the load operation current.

To operate the duct cap 20, a current applied when operating the cap-driving part 300, that is, an operation current, is sensed by a current-sensing part 400. Thus, when the cap-driving part 300 operates initially, the current-sensing part 400 senses the operation current of the cap-driving part 300 as the starting current. While the cap-driving part 300 is driven, the current-sensing part 400 senses the normal operation current or the load operation current as the operation current of the cap-driving part 300 according to a load applied to the duct cap 20.

A control part 500 (e.g., an electronic controller, a processor, etc.) controls the dispensing of ice through the dispenser. For instance, the control part 500 controls the cap-driving part 300 to rotate the duct cap 20 to close or open the ice duct 10 according to an operation signal input to the input part 100.

When abnormal operation of the duct cap 20 is sensed while the duct cap 20 closes the ice duct 10, the control part 500 controls the cap-driving part 300 such that the duct cap 20 opens the ice duct 10. In some implementations, the control part 500 controls the cap-driving part 300 such that the duct cap 20 repeats opening and closing operation of the ice duct 10 at least one time until the duct cap 20 operates normally. The abnormal operation of the duct cap 20 is detected when an abnormal load is applied to the duct cap 20 while the duct cap 20 closes the ice duct 10. Whether the abnormal load is applied to the duct cap 20 is determined according to whether an operation time for the duct cap 20 to rotate from the position where the duct cap 20 opens the ice duct 10 to the position where the duct cap 20 closes the ice duct 10 is greater than a set time, and/or according to whether an operation current of the cap-driving part 300 sensed by the current-sensing part 400 while the duct cap 20 rotates from the position where the duct cap 20 opens the ice duct 10 to the position where the duct cap 20 closes the ice duct 10 is greater than a preset reference current. The reference current may be set at least to the starting current and the load operation current, or more.

For example, when ice is caught between the ice duct 10 and the duct cap 20, the duct cap 20 does not close the ice duct 10 completely. Thus, the hall sensor 30 fails to sense that the duct cap 20 arrives at the position where the duct cap 20 closes the ice duct 10 prior to the operation time expiring, or the current-sensing part 400 senses that the operation current of the cap-driving part 300 is greater than the reference current while the duct cap 20 closes the ice duct 10.

When an abnormal operation of the duct cap 20 is sensed and the duct cap 20 repeats the opening and closing operation for the ice duct 10, the control part 500 controls the cap-driving part 300 to gradually reduce the operation time of the duct cap 20. For instance, as the repeated number of opening and closing operations of the duct cap 20 for the ice duct 10 increases, possibility that a foreign substance is removed between the ice duct 10 and the duct cap 20 also increases. Thus, gradually reducing the opening and closing time of the duct cap 20 for the ice duct 10 reduces an amount of air in the ice-making device that escapes through the ice duct 10 to the outside by the rotation of the duct cap 20 opening and closing the ice duct 10. In this regard, leakage of cold air from the ice-making chamber may be reduced when attempting to correct abnormal operation of the duct cap 20.

When the operation of the duct cap 20 opening and closing the ice duct 10 is repeated a preset number of times by the cap-driving part 300 and the hall sensor 30 still fails to sense that the duct cap 20 moves from the position where the duct cap 20 opens the ice duct 10 to the closing position before the set time is over, the control part 500 controls the warning part 200 to provide a warning indicating abnormal operation of the duct cap 20. Providing the warning may alert a user to the abnormal operation of the duct cap 20 and, thereby, allow the user to correct the abnormal operation (e.g., remove an ice piece that is preventing the duct cap 20 from closing). This may result in correction of the abnormal operation more quickly and, therefore, reduce an amount of cold air that leaks from the ice-making chamber due to the abnormal operation.

The set time, the reference current, and the set number of times are stored in a memory part 600 (e.g., a random access memory, read only memory, or any type of electronic storage device) and may be user-configurable. The memory part 600 may store the operation times of the duct cap 20 depending on the set number.

Figure 4:
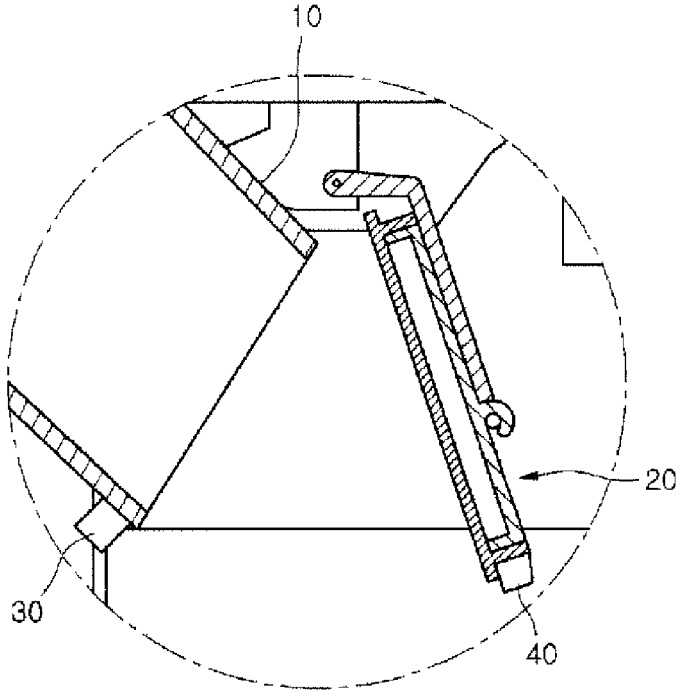
FIGS. 4 to 6 are views illustrating operation of an ice-making device.
Figure 5:
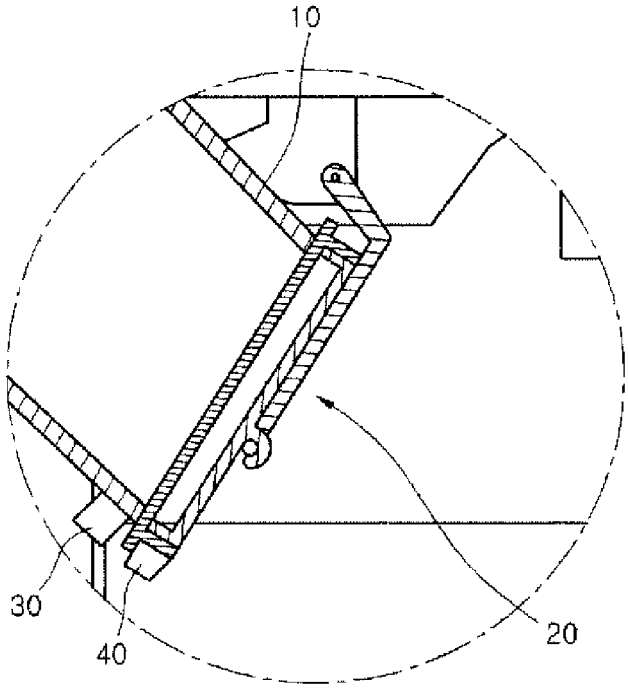
Figure 6:
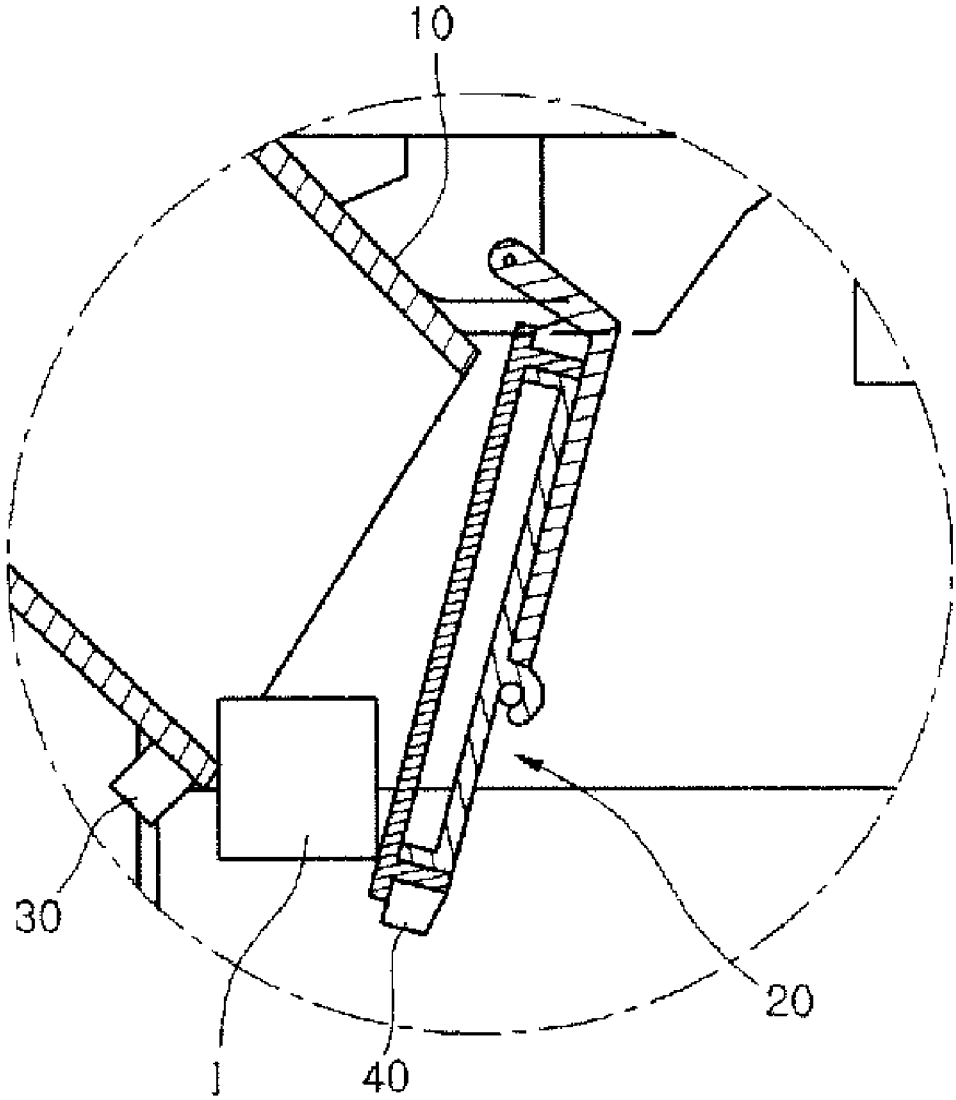

FIGS. 4 to 6 illustrate example operation of an ice-making. Referring to FIG. 4, the input part 100 (refer to FIG. 3) receives an operation signal for dispensing ice through the dispenser, and the control part 500 (refer to FIG. 3) controls the cap-driving part 300 (refer to FIG. 3) to rotate the duct cap 20 to open the ice duct 10 in response to the operation signal for dispensing ice through the dispenser. Thus, the ice made at the ice-making device is dispensed through the ice duct 10. At this point, the hall sensor 30 senses that the magnetic field of the magnet 40 of the duct cap 20 is relatively weak (e.g., absent or less than a threshold), and thus senses that the duct cap 20 is disposed at the position of opening the ice duct 10. The current-sensing part 400 (refer to FIG. 3) senses the operation current of the cap-driving part 300 as the starting current.

Referring to FIG. 5, when the dispensing of the ice through the ice duct 10 is finished, the control part 500 controls the cap-driving part 300 to rotate the duct cap 20 to close the ice duct 10. Thus, the ice duct 10 is closed to finish the dispensing of the ice through the ice duct 10. At this point, the hall sensor 30 senses that the magnetic field of the magnet 40 of the duct cap 20 is relatively strong (e.g., present or greater than a threshold), and thus senses the duct cap 20 is disposed at the position of closing the ice duct 10. The current-sensing part 400 senses the operation current of the cap-driving part 300 as the normal operation current.

While the control part 500 controls the cap-driving part 300 such that the duct cap 20 closes the ice duct 10, when an ice piece I is caught between the ice duct 10 and the duct cap 20, the duct cap 20 fails to close the ice duct 10 completely. Thus, the hall sensor 30 senses that the magnetic field of the magnet 40 of the duct cap 20 is relatively weak (e.g., absent or less than a threshold) and thus senses that the duct cap 20 is not disposed at the position of closing the ice duct 10. At this point, the current-sensing part 400 senses the operation current of the cap-driving part 300 as an abnormal operation current. Based on detecting that the duct cap 20 is not disposed at the position of closing the ice duct 10 and sensing the abnormal operation current, the control part 500 controls the duct cap 20 to rotate to open the ice duct 10 or controls the duct cap 20 to rotate to open and close the ice duct 10 a set number of times.

Figure 7:
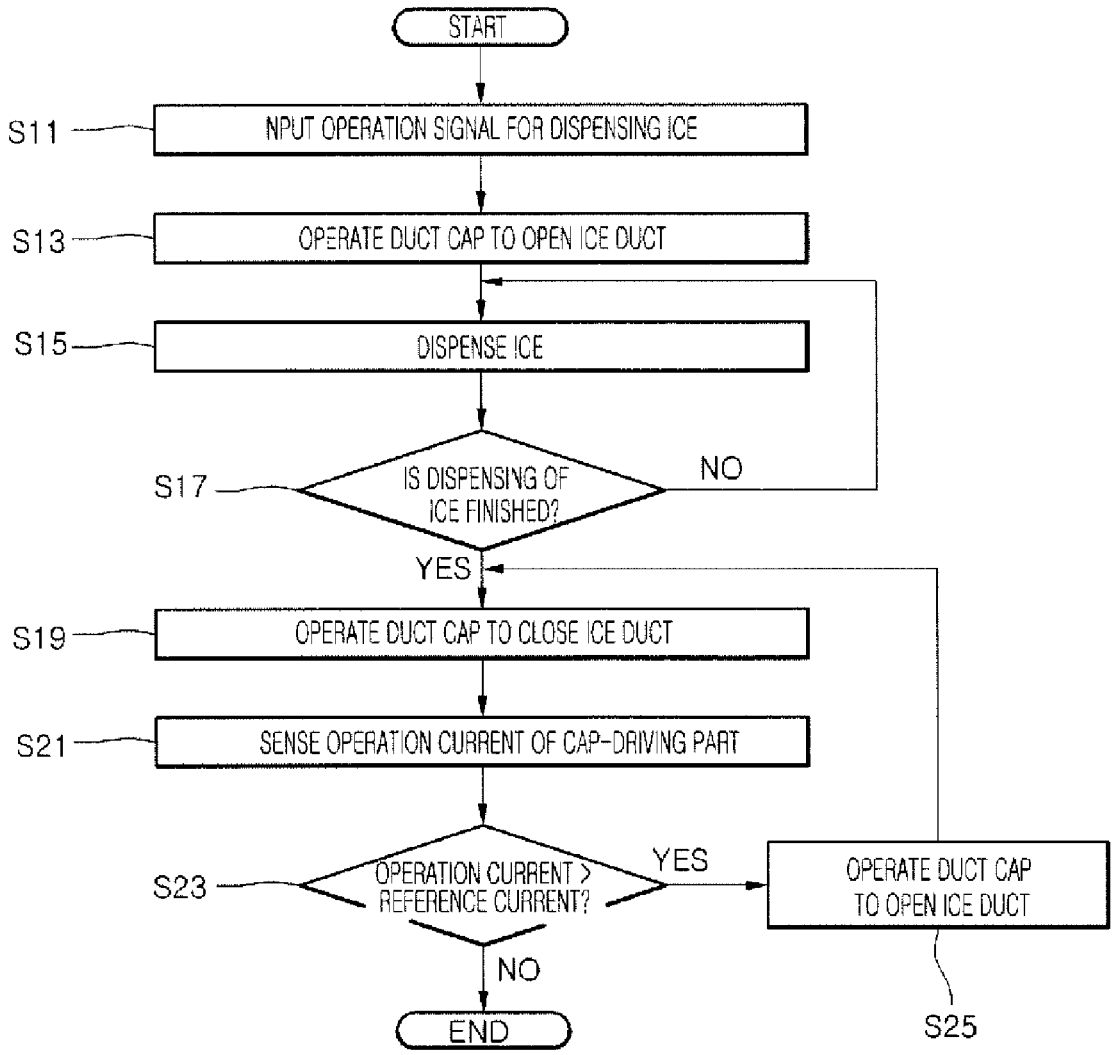
FIG. 7 is a flowchart illustrating a method of controlling an ice-making device.

FIG. 7 illustrates an example of a method of controlling an ice-making device.

Referring to FIG. 7, the input part 100 receives an operation signal starting the dispensing of ice through the dispenser (S11). The input part 100 may receive the operation signal starting the dispensing of the ice through the dispenser by receiving a user's press of an operation button (not shown) or receiving a user's press of a lever (not shown) with a container for receiving ice.

When the input part 100 receives the operation signal for dispensing the ice (S11), the control part 500 controls the operation of the cap-driving part 300 such that the duct cap 20 opens the ice duct 10 (S13). After the ice duct 10 is opened by the duct cap 20 (S13), the ice is dispensed through the ice duct 10 (S15).

Then, it is determined whether the dispensing of the ice through the ice duct 10 is finished (S17). For example, whether the dispensing of the ice through the ice duct 10 is finished may be determined according to whether the input part 100 receives an operation signal finishing the dispensing of the ice, according to whether the input part 100 further receives the operation signal for dispensing the ice (e.g., whether a user continues to supply a constant pressing force to a dispensing control button or lever), or according to whether the time for dispensing the ice, set according to the operation signal dispensing the ice and input to the input part 100 is finished.

When it is determined that the dispensing of the ice through the ice duct 10 is finished (S17), the control part 500 controls the operation of the cap-driving part 300 such that the duct cap 20 closes the ice duct 10 (S19). Thus, the duct cap 20 operates to close the ice duct 10.

When the duct cap 20 starts to operate to close the ice duct 10 (S19), the current-sensing part 400 senses the operation current applied to the cap-driving part 300 (S21). While the duct cap 20 closes the ice duct 10 (S21), it is determined whether the operation current of the cap-driving part 300 sensed by the current-sensing part 400 is greater than the reference current (S23).

When it is determined that the operation current of the cap-driving part 300 sensed by the current-sensing part 400 is the reference current or less (S23), the normal operation current is applied to the cap-driving part 300. Thus, the duct cap 20 operates normally to close the ice duct 10 and the closing operation of the duct cap 20 completes.

However, when it is determined that the operation current of the cap-driving part 300 sensed by the current-sensing part 400 is greater than the reference current (S23), the control part 500 controls the cap-driving part 300 such that the duct cap 20 opens the ice duct 10 (S25). Then, the control part 500 controls the cap-driving part 300 such that operations associated with reference numerals (S19) to (S23) are repeated.

Figure 8:
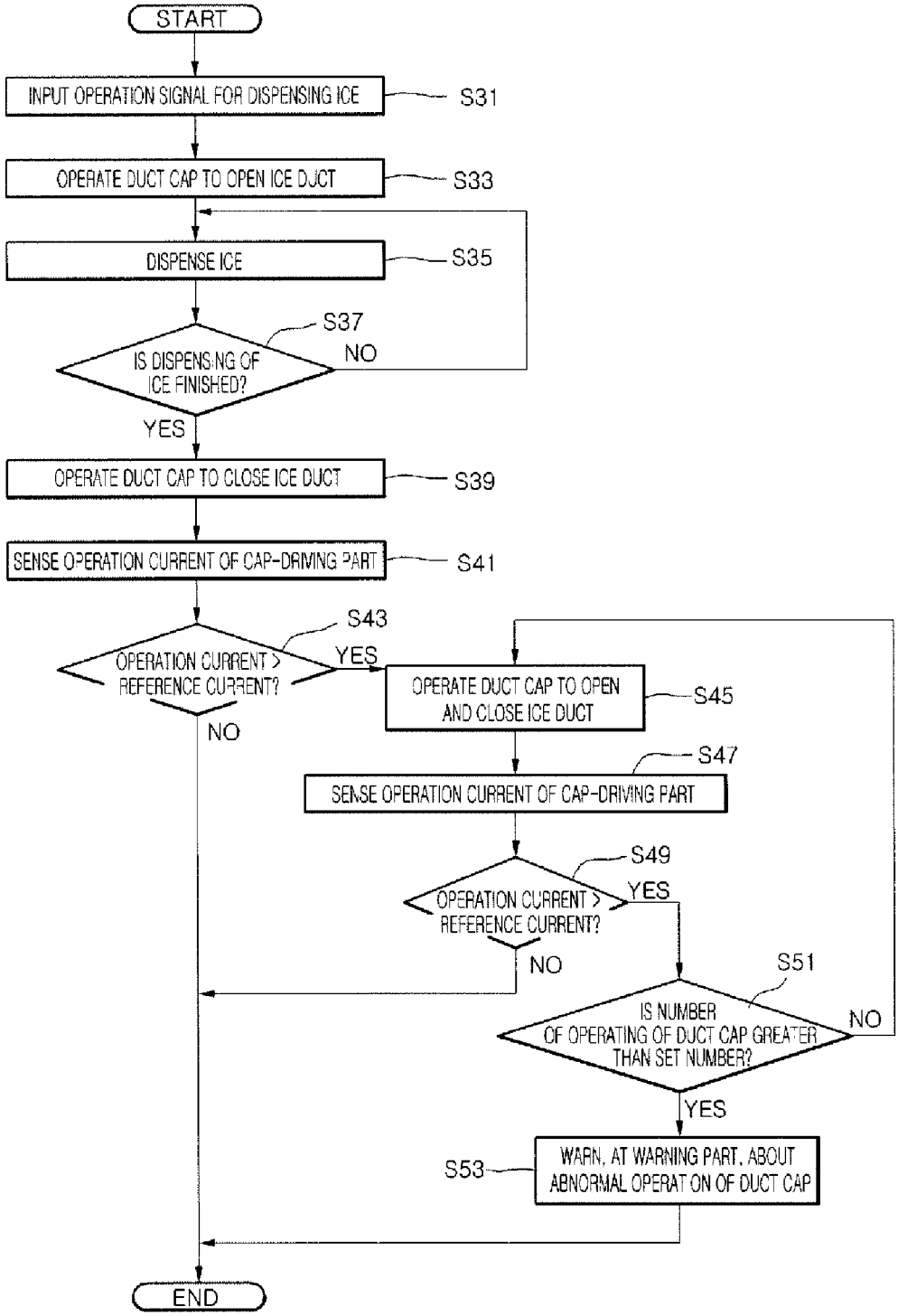
FIG. 8 is a flowchart illustrating a method of controlling an ice-making device.

FIG. 8 illustrates an example of a method of controlling an ice-making device.

Referring to FIG. 8, the input part 100 receives an operation signal starting the dispensing of ice through the dispenser (S31). Then, according to the operation signal input to the input part 100, the control part 500 controls the cap-driving part 300 such that the duct cap 20 opens the ice duct 10 (S33), so that the ice is dispensed through the ice duct 10 (S35).

It is determined whether the dispensing of the ice through the ice duct 10 is finished (S37). When it is determined that the dispensing of the ice through the ice duct 10 is finished, the control part 500 controls the cap-driving part 300 such that the duct cap 20 closes the ice duct 10 (S39).

When the cap-driving part 300 starts to operate such that the duct cap 20 closes the ice duct 10 (S39), the current-sensing part 400 senses the operation current of the cap-driving part 300 (S41). Then, it is determined whether the operation current of the cap-driving part 300 sensed by the current-sensing part 400 is greater than the reference current (S43). When it is determined that the operation current of the cap-driving part 300 sensed by the current-sensing part 400 is the reference current or less (S43), the duct cap 20 operates normally to close the ice duct 10, and thus the closing operation of the duct cap 20 completes.

However, when it is determined that the operation current of the cap-driving part 300 sensed by the current-sensing part 400 is greater than the reference current (S43), the control part 500 controls the cap-driving part 300 such that the duct cap 20 opens and closes the ice duct 10 (S45). The current-sensing part 400 senses the operation current of the cap-driving part 300 (S47), and it is determined whether the operation current of the cap-driving part 300 sensed by the current-sensing part 400 is greater than the reference current (S49).

When it is determined that the operation current of the cap-driving part 300 sensed by the current-sensing part 400 is the reference current or less (S49), the duct cap 20 operates normally to close the ice duct 10, and thus the closing operation of the duct cap 20 completes.

However, when it is determined that the operation current of the cap-driving part 300 sensed by the current-sensing part 400 is greater than the reference current (S49), it is determined whether the number of repeated opening and closing operations of the duct cap 20 is greater than a preset number (S51). When it is determined that the number of the repeated opening and closing operations of the duct cap 20 is the preset number or less (S51), the control part 500 controls the cap-driving part 300 such that operations associated with reference numerals (S45) to (S51) are repeated.

When it is determined that the number of the repeated opening and closing operations of the duct cap 20 is greater than the preset number (S51), the control part 500 controls the warning part 200 to warn about abnormal operation of the duct cap 20 (S53). The warning part 200 may warn through a lamp on/off, display of characters or symbols, any type of visual display, or (e.g., a voice output).

Although the ice-making device has been described as being installed in the ice-making chamber disposed on a back surface of the refrigerator compartment door, the present disclosure is not limited thereto. For example, the ice-making device may be installed in an ice-making chamber located inside of the refrigerator compartment door (e.g., within a storage space defined by the refrigerator compartment and separate from the door). Also, the ice-making device may be installed on a back surface of a freezer compartment door or located inside of the freezer compartment door (e.g., within a storage space defined by the freezer compartment and separate from the door).

Although the duct cap has been described as rotating to open or close the ice duct, the duct cap 20 is not limited to a rotating operation to open or close the ice duct. For example, the duct cap may be translated (e.g., slid) to open or close the ice duct.

The ice duct is a member for dispensing the ice, and the duct cap is a member for opening or closing the member for dispensing the ice. Thus, if the above-described functions can be performed, members and/or devices under any names may be substantially denoted as the same configuration as the ice duct and the duct cap.

In some examples, times in which the duct cap fails to close the ice duct because of ice caught between the ice duct and the duct cap may be reduced. This makes it possible to reduce cool air in the refrigerator compartment and the ice-making chamber from being discharged through the ice duct to the outside.

Also, a user may be warned when the duct cap fails to close the ice duct completely even when the operation of the duct cap for opening and closing the ice duct is performed a plurality of times. Thus, the user can remove ice between the ice duct and the duct cap. This may improve operation reliability and efficiency of the dispenser.

It will be understood that various modifications may be made without departing from the spirit and scope of the claims. For example, advantageous results still could be achieved if steps of the disclosed techniques were performed in a different order and/or if components in the disclosed systems were combined in a different manner and/or replaced or supplemented by other components. Accordingly, other implementations are within the scope of the following claims.

What is claimed is:

1. An ice-making device comprising:

a duct through which ice is dispensed;

a duct-covering part configured to open and close the duct;

a first sensor part disposed at one of the duct and the duct-covering part and configured to sense whether the duct-covering part is positioned to close the duct;

a driving part configured to provide force that moves the duct-covering part to selectively open and close the duct;

a second sensor part configured to sense an operation current of the driving part when the driving part is providing force in attempting to move the duct-covering part to close the duct;

a memory configured to store current information, the current information including a first preset reference current that is greater than a second current sensed by the second sensor part during an abnormal load; and a control part that is configured to:

determine whether the operation current of the driving part sensed by the second sensor part when the driving part is providing force in attempting to move the duct-covering part to close the duct is greater than the first preset reference current, and control the driving part to move the duct-covering part to open the duct in response to a determination that the operation current of the driving part sensed by the second sensor part when the driving part is providing force in attempting to move the duct-covering part to close the duct is greater than the first preset reference current.

2. The ice-making device according to claim 1, wherein the control part is configured to control the driving part to move the duct-covering part to repeatedly open and attempt to close the duct until the operation current of the driving part sensed by the second sensor part reaches a third current that is greater than the first preset reference current.

3. The ice-making device according to claim 2, further comprising a warning part configured to output a warning to a user, wherein the control part is configured to determine whether the operation of opening and closing the duct has been repeated because the operation current is greater than the first preset reference current a preset number of times and control the warning part to output the warning to the user in response to a determination that the operation of opening and closing the duct has been repeated the preset number of times.

4. The ice-making device according to claim 2, wherein the first preset reference current is equal to or greater than a fourth current sensed at the second sensor part when the duct-covering part is in an initial operation.

5. The ice-making device according to claim 1, wherein the first sensor part is disposed at the duct.

6. The ice-making device according to claim 1, wherein the first sensor part is disposed at the duct-covering part.

7. The ice-making device according to claim 1, wherein the first sensor part includes a first component disposed at the duct-covering part and a second component disposed at the duct.

8. The ice-making device according to claim 7, wherein the first component and the second component are components of a hall sensor that constitutes the first sensor part.

9. The ice-making device according to claim 1, wherein the second current comprises a load operation current sensed by the second sensor part when a foreign substance is caught between the duct and the duct-covering part.

10. The ice-making device according to claim 1, wherein the load operation current is a load operation current sensed by the second sensor part when ice is caught between the duct and the duct-covering part.

11. The ice-making device according to claim 1, wherein the driving part is configured to apply a starting current during initial driving of the duct-covering part in attempting to move the duct-covering part to close the duct and, after the initial driving, apply a normal operation current in attempting to move the duct-covering part to close the duct, the normal operation current being less than the starting current.

12. The ice-making device according to claim 11, wherein the first preset reference current is greater than the normal operation current and the starting current.

13. The ice-making device according to claim 1, wherein the control part is configured to control the driving part to move the duct-covering part to repeatedly open and attempt to close the duct until the first sensor part senses that the duct-covering part is positioned to close the duct.

14. The ice-making device according to claim 13, wherein the control part is configured to gradually reduce an operation time of the duct-covering part as a repeated number of opening and closing operations of the duct-covering part increases.

15. The ice-making device according to claim 1, wherein the control part is configured to reduce an operation time of the duct-covering part when repeatedly opening and attempting to close the duct-covering part.

16. The ice-making device according to claim 15, wherein the control part is configured to gradually reduce the operation time of the duct-covering part as a number of repeated opening and attempts to close the duct-covering part increases.

17. The ice-making device according to claim 1, wherein, in attempting to close the duct, the first sensor part senses that the duct-covering part is not positioned to close the duct and, at that point, the second sensor part senses the operation current of the driving part.

18. The ice-making device according to claim 1, wherein, in attempting to close the duct, the first sensor part senses that the duct-covering part is not positioned to close the duct and, at that point, the second sensor part senses an abnormal operation current of the driving part that meets the first preset reference current.

* * * * *